US006623566B1

(12) United States Patent
Senkov et al.

(10) Patent No.: US 6,623,566 B1
(45) Date of Patent: Sep. 23, 2003

(54) METHOD OF SELECTION OF ALLOY COMPOSITIONS FOR BULK METALLIC GLASSES

(75) Inventors: Oleg N. Senkov, Beavercreek, OH (US); Daniel B. Miracle, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/939,289

(22) Filed: Aug. 22, 2001

Related U.S. Application Data

(60) Provisional application No. 60/308,800, filed on Jul. 30, 2001.

(51) Int. Cl.[7] ..... H01F 1/153; H01F 1/16

(52) U.S. Cl. ..... 148/121; 148/100; 148/403

(58) Field of Search ..... 148/100, 121, 148/304, 403

(56) References Cited

U.S. PATENT DOCUMENTS

| | | | | | |
|---|---|---|---|---|---|
| 4,231,816 | A | * | 11/1980 | Cuomo et al. | 148/304 |
| 4,781,803 | A | * | 11/1988 | Harris et al. | 148/403 |
| RE32,925 | E | * | 5/1989 | Chen et al. | 148/403 |
| 5,035,755 | A | * | 7/1991 | Nathasingh et al. | 148/304 |
| 5,368,659 | A | * | 11/1994 | Peker et al. | 148/403 |
| 5,370,749 | A | * | 12/1994 | Ames et al. | 148/304 |
| 5,593,514 | A | * | 1/1997 | Giessen et al. | 148/403 |

OTHER PUBLICATIONS

"*Effect of the Atomic Size Distribution on Glass Forming Ability of Amorphous Metallic Alloys*," Senkov et al, *Materials Research Bulletin,* vol 36:12, pp 2183–2198 (2001).

"*Topological Criterion for Metallic Glass Formation*," Miracle et al, *In Press, Materials Science and Engineering,* A00 (2000) 1–9.

"*Stabilization of Metallic Supercooled Liquid and Bulk Amorphous Alloys*," Akihisa Inoue, *Acta Materialia,* 48 (2000) 279–306.

"*Atomic Size Effect on the Formability of Metallic Glasses*," T. Egami et al, *J Non–Cryst Solids,* 64 (1984) 113–134.

"*The Atomic Structure of Aluminum Based Metallic Glasses and Universan Criterion for Glass Formation*," T. Egamai, *J Non–Cryst Solids,* 205–207 (1996) 575–582.

* cited by examiner

*Primary Examiner*—John Sheehan
(74) *Attorney, Agent, or Firm*—Bobby D. Scearce; Thomas L. Kundert

(57) ABSTRACT

A method for selecting alloying elements for complex, multi-component amorphous metal alloys is provided in which the solvent element is the largest atom with a concentration of 40–80 at %, the second most concentrated element has a radius of 65–83 % the radius of the solvent atom and a concentration of 10–40 at % in the alloy, with other elements selected at lower concentrations. For ternary alloys specified by this invention, the third element must have an atomic radius within 70–92 % of the solvent atom radius. In the preferred embodiment, alloys with four or more elements are specified, where the third elements must have an atomic radius within 70–80 %, the fourth element must have an atomic radius within 80–92 % of the solvent atom radius, and all other solute elements must have atomic radii within 70–92 % of the solvent atom radius. The concentrations of elements that have radii that differ by less than 1 % from one another are added together and treated as a single alloy addition for the purpose of this invention.

4 Claims, 4 Drawing Sheets

FIG 1a
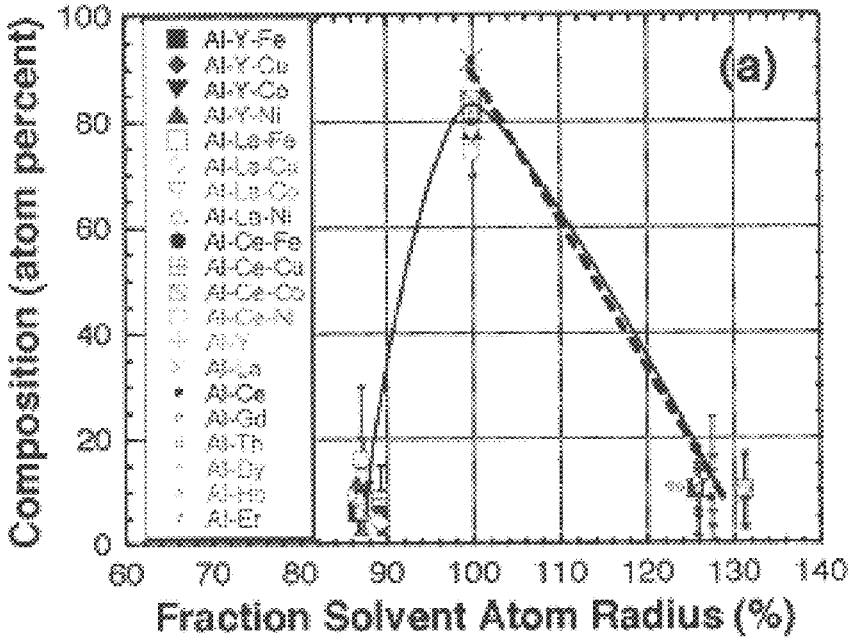
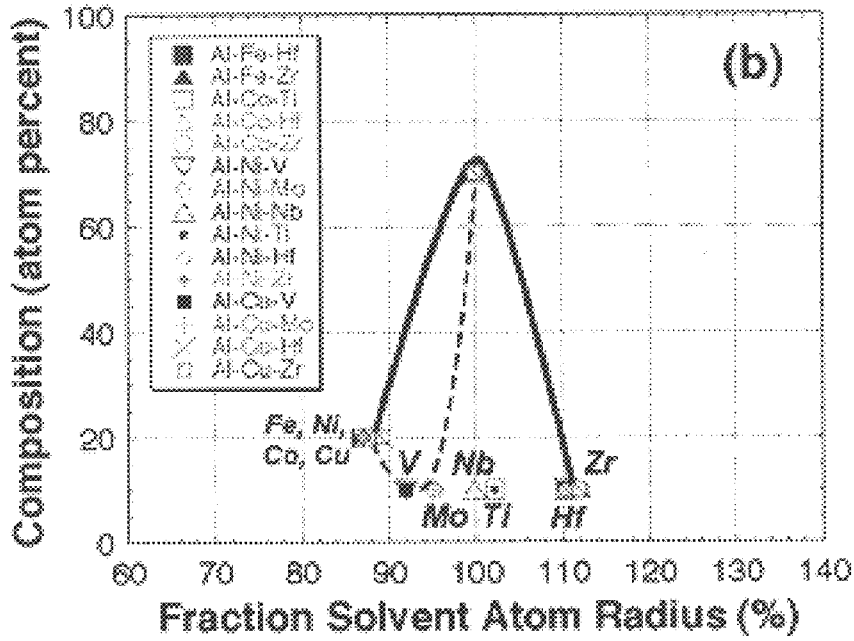
FIG 1b

METHOD OF SELECTION OF ALLOY COMPOSITIONS FOR BULK METALLIC GLASSES

CROSS-REFERENCE TO RELATED APPLICATION

This application claims priority of the filing date of Provisional Application Ser. No. 60/308,800 filed Jul. 30, 2001, the entire contents of which are incorporated by reference herein.

RIGHTS OF THE GOVERNMENT

The invention described herein may be manufactured and used by or for the Government of the United States for all governmental purposes without the payment of any royalty.

BACKGROUND OF THE INVENTION

The present invention relates generally to systems and methods for producing metal alloys, and more particularly to a method for selecting alloying elements for complex, multi-component amorphous metal alloys in the production of amorphous phase metal alloys in bulk form.

Amorphous metallic alloys have unique mechanical and physical properties attributed to the atomic structure of the amorphous phase. Generally, high cooling rates above $10^5$ K/s are required to produce amorphous alloys in ribbon, flake or powder form, with the resulting sample thickness less than 50 $\mu$m (Luborsky (Ed), Amorphous Metallic Alloys, Butterworths, London (1983)), and efforts have been made to consolidate the material into bulk form. New multi-component alloy systems with lower critical cooling rates ($<10^2$ K/s) have been developed that can produce fully amorphous products by conventional casting to thickness up to about 100 mm (Inoue, *Progress in Materials Science*, 43 (1998) 365–520); Johnson, in Johnson et al (Eds), *Bulk Metallic Glasses*, MRS Symposium Proceedings, 554, Materials Research Society, Warrendale, Pa. (1999) 311–339; Inoue, *Acta Materialia*, 48 (2000) 279–306). Most of these bulk amorphous alloys contain very expensive elements of platinum and/or lanthanum groups that limit their application, and only zirconium-based alloys not containing these elements have found successful use (see Johnson, supra).

After the discovery of amorphous alloys, attempts were made to understand the amorphization mechanism in order to predict alloy compositions with better glass forming ability. Three empirical rules were defined for the bulk amorphous alloy systems (Inoue, *Acta Materialia*, supra), namely, (a) requires three or more elements: (b) difference in atomic size ratios above about 12% among the three main constituent elements; and (c) negative heats of mixing among the three main constituent elements. The glass formation composition range usually coincides with a eutectic region, and a reduced glass transition temperature, $T_{rg}=T_g/T_m$, as high as 0.6–0.7 is typical for easy glass formers (Davies, in Luborsky, supra, 8–25). ($T_m$ is the absolute liquidus temperature and $T_g$ is the absolute glass transition temperature.) The density difference between the amorphous and fully crystalline states for bulk amorphous alloys is in the range of about 0.3–0.54%, smaller than the 2% characteristic of ordinary amorphous alloys (Matgumoto (Ed), *Materials Science of Amorphous Alloys*, Ohmu, Tokyo (1983); Yavari et al, in Johnson et al (Eds), supra, 21–30). This indicates that bulk amorphous alloys have higher dense randomly packed atomic configurations than ordinary amorphous alloys. Formation of the liquid with specific atomic configurations and multi-component interactions on a short-range scale have been suggested to increase the solid/liquid interfacial energy and decrease atomic diffusivity, which, in turn, leads to suppression of nucleation and growth of crystalline phases (Inoue, *Acta Materialia*, supra). Topological complexity and frustration were given (Johnson, supra) as another explanation of suppression of crystallization in the multicomponent alloys.

The empirical rules are rather general, and new amorphous alloy development has remained a time-consuming, labor-intensive trial and error process of selection,and screening various element combinations using empirical selection guidelines and requiring expensive laboratory equipment to test candidate alloys. Specific criteria for selection of easy glass forming alloy systems would significantly advance the art. The importance of atomic size and critical concentration of alloying elements in phase stability is summarized in empirical Hume-Rothery rules, and a fundamental basis for these rules has recently been identified (Egami et al, *J Non-Cryst Solids*, 64 (1984) 113–134), leading to development of a topological criterion for metallic glass formation (Egami et al, supra; and Egami, *J Non-Cryst Solids*, 205–207 (1996) 575–582). According to this criterion, a minimum concentration of alloying elements required for amorphization decreases continuously with increased difference in atomic sizes of solute and solvent elements. This behavior is typical for ordinary amorphous metals with a critical cooling rate greater than $10^4$ K/s, but the behavior is not typical for bulk amorphous alloys, and the criterion is therefore not useful for the specification of bulk metallic glasses.

The invention solves or substantially reduces problems with previously existing metal alloy specification approaches and methods by providing a method for selecting alloying elements for complex, multi-component amorphous metal alloys. In this method, the atom radii of selected elements are plotted along the x-axis and the concentrations in atomic percent (at %) are plotted along the y-axis. Each alloying element forms a single point and all points for a given alloy provide a distribution of atomic sizes and concentrations that characterize the system. The alloying elements are selected so that the solvent is the largest atom with a concentration of 40–80 at %. The next most concentrated element has the smallest radius within 65–83% of the radius of the solvent atom and a concentration in the range 10–40 at %. Other elements are selected at lower concentrations and have atomic radii within 70–92% of the radius of the solvent atom, so that a single, broad, concave upward atomic size distribution plot is obtained. In the preferred embodiment, alloys with four or more elements are specified, where at least one of the other solute elements has an atomic radius within 70–80% and at least one has an atomic radius within 80–92% of the solvent atom radius. The concentration of elements that have radii that differ by less than 1% from one another are added together and treated as a single alloy addition for the purpose of this invention.

It is a principal object of the invention to provide bulk amorphous metal alloys.

It is another object of the invention to provide an improved method for producing amorphous metal alloys.

It is another object of the invention to provide a method for predicting alloying element concentrations in production of bulk amorphous metal alloys.

It is another object of the invention to provide a method for producing amorphous metal alloys in bulk form with a minimum dimension of one mm or more.

It is a further object of the invention to provide a method for producing bulk amorphous metal alloys for use in construction, electronics, medicine, sports, and other applications as would occur to the skilled artisan practicing the invention.

These and other objects of the invention will become apparent as a detailed description of representative embodiments proceeds.

SUMMARY OF THE INVENTION

In accordance with the foregoing principles and objects of the invention, a method for selecting alloying elements for complex, multi-component amorphous metal alloys is provided in which the solvent element is the largest atom with a concentration of 40–80 at %, the second most concentrated alloying element has a radius of 65–83% the radius of the solvent atom and a concentration of 10–40 at % in the alloy. Other alloying elements are selected at lower concentrations and have atom radii of 70–92% of the radius of the solvent atom. In the preferred embodiment, alloys with four or more elements are specified, where at least one of the other alloying elements must have an atomic radius within 70–80% and at least one must have an atomic radius within 80–92% of the solvent atom radius. The concentrations of elements that have radii that differ by less than 1% from one another are added together and treated as a single alloy addition for the purpose of this invention.

DESCRIPTION OF THE DRAWINGS

The invention will be more clearly understood from the following detailed description of representative embodiments thereof read in conjunction with the accompanying drawings wherein:

FIGS 1*a* and 1*b* show normalized atomic size distribution plots for amorphous aluminum alloys with (a) rare earth and transition metal solutes and (b) early and late transition metal additions, wherein all radii have been normalized with respect to the radius of aluminum;

DETAILED DESCRIPTION

Theoretical considerations and underlying principles of operation of the invention may be found in "*Effect of the Atomic Size Distribution on Glass Forming Ability of Amorphous Metallic Alloys*," Senkov et al, Materials Research Bulletin, Vol 36:12, pp 2183–2198 (2001) (herein referred to as Senkov), and "*Topological Criterion for Metallic Glass Formation*," Miracle et al, In Press, *Materials Science and Engineering*, A00 (2002) pp 1–9, (herein referred to as Miracle).

The model for metallic glass formation described in Senkov, supra, and Miracle, supra, forms a basis for the invention. In accordance with a governing principle of the invention, it is recognized that a topological instability of a crystal lattice due to internal stresses is produced by alloying solute element(s) occupying either interstitial and substitutional sites. Elements may partition between the two sites and the relative site frequency is a function of the strain energy associated with each site. The strain energy depends on solute and solvent elastic properties and relative sizes and temperature. When the solvent element is the largest atom in the alloy, interstitial elements cause lattice expansion (i.e. positive lattice strain), and substitutional elements cause lattice contraction (i.e. negative lattice strain). According to the model taught by the invention the critical concentration of a solute element required to destabilize the crystalline lattice decreases, reaches a minimum and then increases when the difference between atomic sizes of the solvent and solute elements increases. The crystalline lattice becomes unstable, which leads to amorphization, when the internal strain from the atomic size differences approaches the critical value, $$\varepsilon_A^V = \frac{\sum_{j=1}^{n} C_j \gamma_j \xi [X_{sj}(R_j^3 - 1) + X_{ij}(R_j^3 - \eta^3)]}{1 + \sum_{j=1}^{n} C_j X_{sj}(R_j^3 - 1)} \quad (1)$$

The subscript j denotes a $j^{th}$ solute element, $CX_s$ is the substitutional solute element concentration, $CX_1$ is the interstitial solute element concentration, $R=R_B/R_A$, $R_B$ is the atomic radius of a solute element B, $R_A$ is the atomic radius of the solvent, $$\gamma = \frac{1 + 4\mu_A / 3K_A}{1 + 4\mu_A / 3K_B},$$

$\xi \approx 0.74$, and $\eta \approx 0.4142$, $\mu_A$ and $K_A$ are the shear modulus and bulk modulus of the solvent, and $K_B$ is the bulk modulus of a solute element B.

In plotting atomic size distribution for an amorphous alloy according to the model taught by the invention, atomic radii may be selected from the open literature. In TABLE 1 are presented the atomic radii of various elements considered in demonstration of the model of the present invention in plotting atomic size distributions for various amorphous alloys, some representative examples of which are presented in the figures herein and in Senkov, supra, and Miracle, supra.

Figure 2:
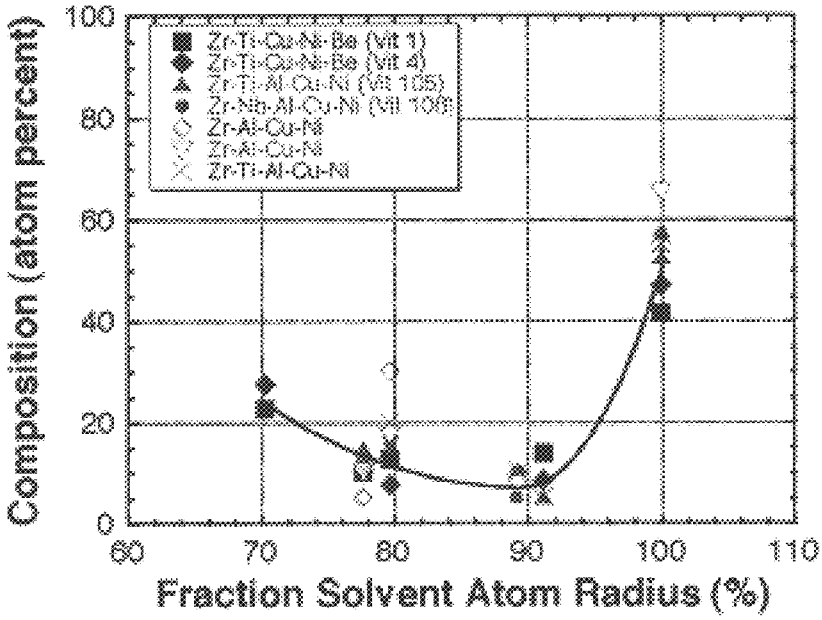
FIG. 2 shows a normalized atomic size distribution plot of amorphous zirconium alloys wherein all radii have been normalized with respect to the radius of zirconium.
Figure 3:
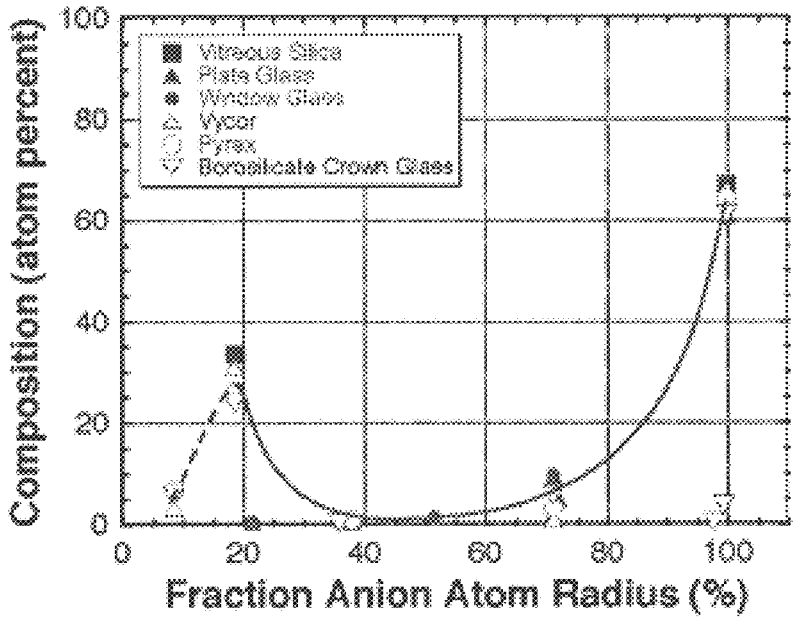
FIG. 3 shows a normalized atomic size distribution plot of common oxide glasses, wherein all radii have been normalized with respect to the radius of the oxygen anions.

Referring now to the drawings, FIGS. 1*a* and 1*b* show normalized atomic size distribution plots for amorphous aluminum alloys with (a) rare earth and transition metal solutes and (b) early and late transition metal additions wherein all radii have been normalized with respect to the radius of aluminum. The atomic size distribution plots illustrated in FIGS. 1*a*, 1*b* are typical for amorphous metal alloys with marginal glass forming ability, for which the critical cooling rate required for amorphization is above $10^4$ K/s. In FIG. 2 is shown a normalized atomic size distribution plot for amorphous zirconium alloys wherein all radii have been normalized with respect to zirconium. The plots for zirconium alloys shown in FIG. 2 are typical for bulk metallic glasses for which the critical cooling rate is below $10^3$ K/s. In FIG. 3 is shown a normalized atomic size distribution plot for common oxide glasses wherein all radii have been normalized with respect to the oxygen anions. The critical cooling rate for glasses shown in FIG. 3 is very low ($<10^{-4}$ K/S).

Figure 4:
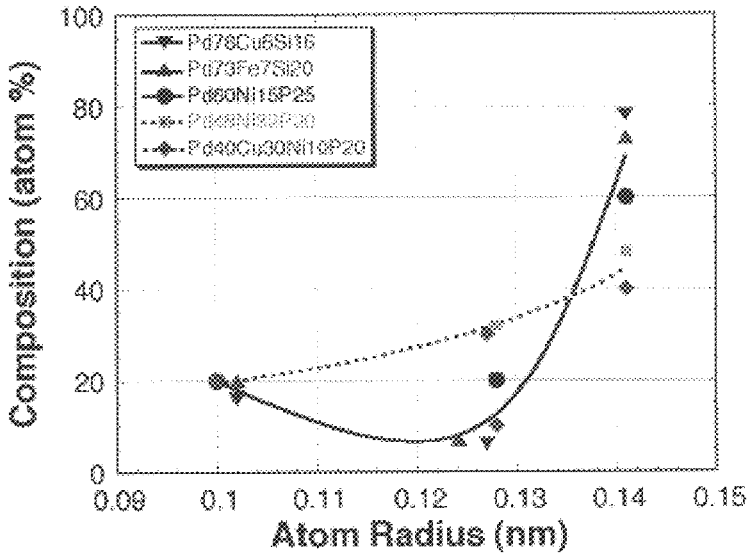
FIG. 4 shows atomic size distribution plots of several Pd-based bulk amorphous alloys.
Figure 5:
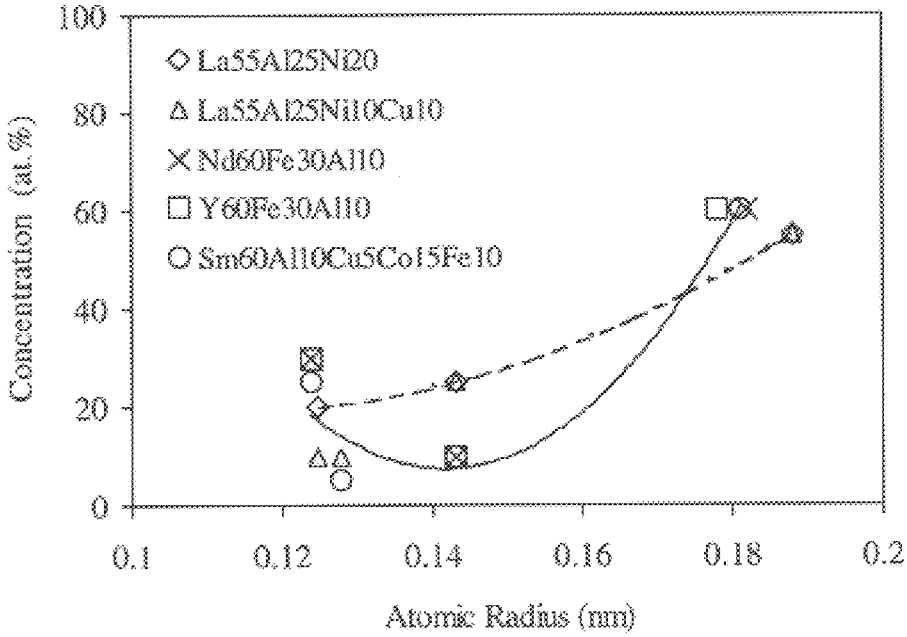
FIG. 5 shows atomic size distribution plots of rare earth based bulk amorphous alloys.
Figure 6:
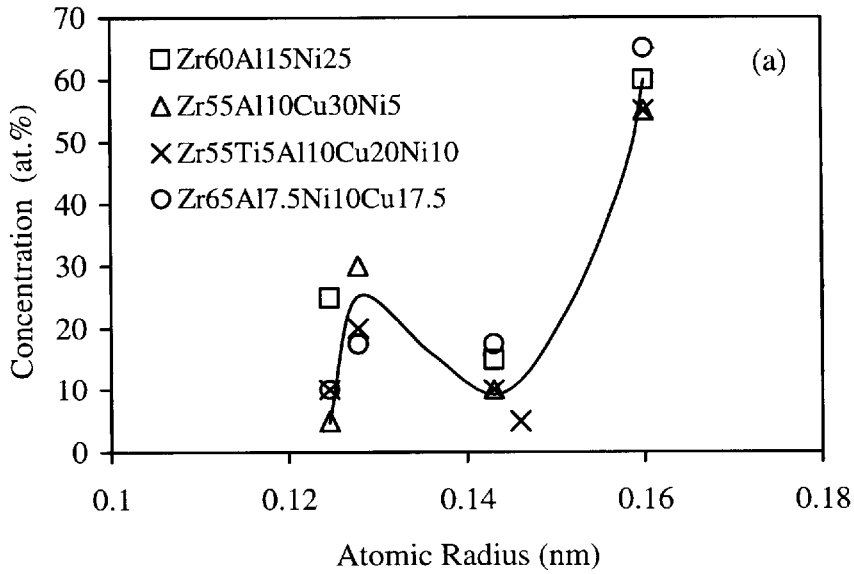
FIG. 6 shows atomic size distribution plots for additional Zr-based bulk amorphous alloys.

FIG. 4 shows atomic size distributions in several palladium based bulk amorphous alloys for which the critical cooling rates are about 10 to 500 K/s. FIG. 5 shows atomic size distributions in several lanthanide (rare earth) based bulk amorphous alloys for which the critical cooling rates are about 10 to 1000 K/s. FIG. 6 shows the atomic size distributions in several additional zirconium based bulk amorphous alloys for which the critical cooling rates are about 1 to 500 K/s.

The foregoing figures illustrate a principle of the invention that atomic size distribution plots transform from a concave downward shape to a concave upward shape when the critical cooling rate decreases below about $10^2$ to $10^3$ K/s. Ordinary amorphous alloys with marginal glass forming ability have single peak distributions with concave downward shape (Senkov, supra) with maxima at intermediate atomic sizes. Good glass formers have concave upward distributions with broad minima at intermediate atomic sizes, similar to those shown in FIGS. 2 to 6, as predicted by the model of the invention. According to the model, all alloying elements in bulk glass formers are smaller than the solvent element and some of them are located in interstitial sites while others substitute for solvent atoms in the corresponding crystalline solid solution. The critical concentration of an alloying element required to amorphize the alloy decreases, approaches a minimum and then increases when the size difference between the alloying element and the matrix atom increases. For example, zirconium, palladium and lanthanide based alloys (FIGS. 2–4,5) have upwardly shaped distributions and may be the best glass formers. Because the bulk glass forming alloys have higher relative density, the concave upward distributions correspond to a more compact atomic structure than alloys having concave downward distributions, and have a higher viscosity and lower diffusivity, which results in decreased atomic diffusion and the nucleation and growth of crystalline phases and strongly enhanced bulk glass formability. Exceptions to the foregoing include some copper and magnesium based alloys.

According to the model of the invention, solute elements with atomic radii less than 80% of the radius of the solvent atom occupy interstitial sites in the solvent crystal lattice, solute elements with atomic radii 83–100% of the radius of the solvent atom occupy substitutional sites, and elements with atomic radii 80–83% of the radius of the solvent atom may occupy both interstitial and substitutional sites. To produce a metallic alloy with good glass forming ability, the alloying elements should be selected such that the solvent is the largest atom with a concentration of about 40–80 at %. The next most concentrated element has the radius of about 65–83% of the radius of the solvent atom, with a concentration of about 10 to 40 at %. Other solute elements are selected at lower concentrations and have atomic radii within 70–92% of the radius of the solvent atom. In the preferred embodiment, alloys with four or more elements are specified, where at least one of the other solute elements must have an atomic radius within 70–80% and at least one must have an atomic radius within 80–92% of the solvent atom radius. The concentrations of elements that have radii that differ by less than 1% from one another are added together and treated as a single alloy addition for the purpose of this invention. The critical strain calculated using Eq (1) should have a positive value in the range 0.06–0.09.

The invention disclosed here provides a clear and simple prescriptive approach for identifying and optimizing complex bulk metallic glasses containing three or more elements. After selecting a desired solvent atom type and composition, between 40–80%, other elements are easily specified by using an atom size distribution plot typical for bulk metallic glasses as described herein. Trade-offs between elements of similar size can be made to optimize other alloy features such as density, availability or environmental resistance, or to optimize other features that may influence glass formability, such as formation of a eutectic reaction with other elements in the alloy, or a large negative heat of mixing with other elements in the alloy. Once the constituent elements and their respective compositions are specified in accordance with the principal teachings of the invention, the is alloys may be prepared by conventional alloying processes known in the applicable art and cooled to the amorphous state in accordance with the teachings hereof or in accord with the teachings of the references incorporated by reference herein.

The entire contents and teachings of all references cited herein are hereby incorporated by reference herein.

The invention therefore provides an improved method for producing bulk amorphous phase metal alloys. It is understood that modifications to the invention may be made as might occur to one skilled in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

TABLE 1

| ELEMENT | RADIUS (nm) | SOURCE |
|---|---|---|
| Oxygen | 0.07300 | (a) |
| Nitrogen | 0.07500 | (a) |
| Carbon | 0.07730 | (a) |
| Boron | 0.08200 | (a) |
| Sulfur | 0.10200 | (a) |
| Phosphorus | 0.10000 | (d) |
| Beryllium | 0.11280 | (c) |
| Silicon | 0.1020 | (d) |
| Germanium | 0.11400 | (d) |
| Iron | 0.12412 | (c) |
| Nickel | 0.12459 | (c) |
| Chromium | 0.12491 | (c) |
| Cobalt | 0.12510 | (c) |
| Copper | 0.12780 | (c) |
| Vanadium | 0.13160 | (c) |
| Ruthenium | 0.13384 | (c) |
| Rhodium | 0.13450 | (c) |
| Manganese | 0.13500 | (a) |
| Osmium | 0.13523 | (c) |
| Iridium | 0.13573 | (c) |
| Technetium | 0.13600 | (c) |
| Molybdenum | 0.13626 | (c) |
| Tungsten | 0.13670 | (c) |
| Rhenium | 0.13750 | (c) |
| Palladium | 0.13754 | (c) |
| Platinum | 0.1410 | (d) |
| Gallium | 0.13920 | (b) |
| Zinc | 0.13945 | (c) |
| Selenium | 0.14000 | (a) |
| Uranium | 0.14200 | (a) |
| Niobium | 0.14290 | (c) |
| Tantalum | 0.14300 | (c) |
| Aluminum | 0.14317 | (c) |
| Gold | 0.14420 | (c) |
| Silver | 0.14447 | (c) |
| Tellurium | 0.14520 | (b) |
| Titanium | 0.14615 | (c) |
| Lithium | 0.15194 | (c) |
| Polonium | 0.15300 | (a) |
| Thulium | 0.15600 | (a) |
| Cadmium | 0.15683 | (c) |
| Hafnium | 0.15775 | (c) |

TABLE 1-continued

| ELEMENT | RADIUS (nm) | SOURCE |
|---|---|---|
| Magnesium | 0.16013 | (c) |
| Zirconium | 0.16025 | (c) |
| Protactinium | 0.16100 | (a) |
| Tin | 0.16200 | (a) |
| Promethium | 0.16300 | (a) |
| Neodymium | 0.16400 | (a) |
| Scandium | 0.16410 | (c) |
| Praseodymium | 0.16500 | (a) |
| Indium | 0.16590 | (b) |
| Ytterbium | 0.17000 | (a) |
| Thallium | 0.17160 | (c) |
| Lutetium | 0.17349 | (c) |
| Lead | 0.17497 | (c) |
| Erbium | 0.17558 | (c) |
| Holmium | 0.17661 | (c) |
| Dysprosium | 0.17740 | (c) |
| Terbium | 0.17814 | (c) |
| Thorium | 0.18000 | (c) |
| Gadolinium | 0.18013 | (c) |
| Yttrium | 0.18015 | (c) |
| Samarium | 0.18100 | (a) |
| Cerium | 0.18247 | (c) |
| Sodium | 0.18570 | (c) |
| Lanthanum | 0.18790 | (c) |
| Calcium | 0.19760 | (c) |
| Europium | 0.19844 | (c) |
| Strontium | 0.21520 | (c) |
| Barium | 0.21760 | (c) |
| Potassium | 0.23100 | (c) |
| Rubidium | 0.24400 | (c) |
| Cesium | 0.26500 | (c) |

Sources:
(a) M. Winter, WebElements ™ Periodic Table, Professional Edition, http://www.webelements.com, University of Sheffield, UK, 2000.
(b) J. L. C. Daams, P. Villars and J. H. N. van Vucht, Atlas of Crystal Structure Types for Intermetallic Phases, Vol. 1–4, ASM International, Materials Park, OH, 1991.
(c) International Tables for X-Ray Crystallography, Birmingham, England, 1968.
(d) T. Egami and Y. Waseda, J Non-Crystalline Solids 64 (1984) 113–134.

We claim:

1. A method for selecting alloying elements for a complex, multi-component amorphous metal alloy containing at least three elements, comprising the steps of:

(a) selecting at least three elements for an amorphous metal alloy including a solvent element and at least two solute elements;

(b) wherein said solvent element is selected to have the largest atomic radius of said at least three elements and an atomic concentration in said alloy in the range of 40 to 80 atom percent;

(c) wherein a first said solute element is selected to have an atomic radius of about 65 to 83 percent of the radius of said solvent element and an atomic concentration in said alloy less than that of said solvent element in the range of 10 to 40 atom percent; and (d) wherein each remaining said solute element is selected to have an atomic radius of about 70 to 92 percent of the radius of said solvent element and an atomic concentration in said alloy less than that of each of said solvent element and said first solute element.

2. The method of claim 1 wherein a plot of atomic radii of said at least three elements along the x-axis versus concentrations in atomic percent of said at least three elements along the y-axis forms a broad, concave upward distribution of the atomic radii and concentrations that characterizes said amorphous alloy.

3. A method for selecting alloying elements for a complex, multi-component amorphous metal alloy containing at least four elements, comprising the steps of:

(a) selecting at least four elements for an amorphous metal alloy including a solvent element and at least three solute elements;

(b) wherein said solvent element is selected to have the largest atomic radius of said at least four elements and an atomic concentration in said alloy in the range of 40 to 80 atom percent;

(c) wherein a first said solute element is selected to have an atomic radius of about 65 to 83 percent of the radius of said solvent element and an atomic concentration in said alloy less than that of said solvent element in the range of 10 to 40 atom percent;

(d) wherein a second said solute element is selected to have an atomic radius of about 70 to 80 percent of the radius of said solvent element and an atomic concentration in said alloy less than that of each of said solvent element and said first solute element;

(e) wherein a third said solute element is selected to have an atomic radius of about 80 to 92 percent of the radius of said solvent element and an atomic concentration in said alloy less than that of each of said solvent element and said first solute element; and (f) wherein each remaining said solute element is selected to have an atomic radius of about 70 to 92 percent of the radius of said solvent element and an atomic concentration in said alloy less than that of each of said solvent element and said first solute element.

4. The method of claim 3 wherein a plot of atomic radii of said at least four elements along the x-axis versus concentrations in atomic percent of said at least four elements along the y-axis forms a broad, concave upward distribution of the atomic radii and concentrations that characterizes said amorphous alloy.

* * * * *